US005481236A

United States Patent [19]

Ruehle et al.

[11] Patent Number: 5,481,236

[45] Date of Patent: Jan. 2, 1996

[54] ENGAGING RELAY FOR THE STARTER OF AN INTERNAL COMBUSTION ENGINE

[75] Inventors: Walter Ruehle, Korntal; Ngoc-Thach Nguyen, Grossbottwar; Arno-Albert Binnenwies, Hildesheim; Hartmut Schuette, Sibbesse, all of Germany

[73] Assignee: Robert Bosch GmbH, Stuttgart, Germany

[21] Appl. No.: 133,180

[22] PCT Filed: Apr. 24, 1992

[86] PCT No.: PCT/DE92/00329

§ 371 Date: Oct. 14, 1993

§ 102(e) Date: Oct. 14, 1993

[87] PCT Pub. No.: WO92/22082

PCT Pub. Date: Dec. 10, 1992

[30] Foreign Application Priority Data

May 27, 1991 [DE] Germany ..... 41 17 242.6

[51] Int. Cl.[6] ..... H01H 67/02

[52] U.S. Cl. ..... 335/126; 335/131

[58] Field of Search ..... 335/126, 131

[56] References Cited

U.S. PATENT DOCUMENTS 4,725,801 2/1988 Snyder ..... 335/126

4,987,396 1/1991 Bögner ..... 335/126

FOREIGN PATENT DOCUMENTS 0099998 8/1984 European Pat. Off. .

2082393 3/1982 Germany .

*Primary Examiner*—Lincoln Donovan

*Attorney, Agent, or Firm*—Michael J. Striker

[57] ABSTRACT

The engaging relay for a starter device of an internal combustion engine includes a magnetic core having a relay coil and provided with a through-opening with a guide section; an armature including a switching axle extending through the through-opening of the magnetic core; a bushing mounted around the switching axle in an axially displaceable manner in the guide section of the core; a contact bridge nonrotatably fixed to the bushing; main current contacts mounted opposite the contact bridge so as to be contactable with the contact bridge by energizing the relay coil; a spring for holding the contact bridge away from the main current contacts in a resting position of the contact bridge; and anti-rotation means for preventing rotation of the bushing in the guide section relative to the magnetic core so as to maintain the contact bridge in a rotationally fixed relationship with the main current contacts.

18 Claims, 5 Drawing Sheets

ENGAGING RELAY FOR THE STARTER OF AN INTERNAL COMBUSTION ENGINE

PRIOR ART

The invention relates to an engaging relay for a starter device (starter, in particular pre-engaged drive starter) of an internal combustion engine, having a magnetic core to which a relay coil is assigned, and having an armature which has a switching axle which penetrates a through-opening of the magnetic core and on which a bushing is arranged which is mounted in a guide section of the through-opening and which bears a contact bridge.

Engaging relays of this kind serve the purpose of switching a high current with a relatively low control current. The high current (starter current) which is required to start an internal combustion engine by means of a starter is for example up to approximately 1000 amps in passenger cars and up to 2500 amps in utility vehicles. Therefore, the starter switch is sufficient to switch on the low control current. The high starter current is switched by means of the engaging relay. However, the engaging relay also has a further function since it serves to move the pinion of the starter forward for engaging in a ring gear of the internal combustion engine. The armature of the engaging relay is connected, for the purpose of switching the starter current, with a contact bridge which connects main current contacts to one another in the excited state of the engaging relay. In order to bring about a suitable contact pressure for switching the large starter current, the contact bridge is acted on axially by means of a spring arrangement and mounted on a switching axle of an armature of the engaging relay. The spring arrangement does not engage directly on the contact bridge but rather indirectly via a bushing which holds the contact bridge. During mounting and in operation, the known engaging relay has disadvantages because the assignment of the position of the contact bridge to its set position is often not maintained with sufficient accuracy.

ADVANTAGES OF THE INVENTION

In comparison with the above, the engaging relay according to the invention having the features specified in the main claim has the advantage that a play-free and positionally accurate assignment of the contact bridge to its set position is maintained. For this purpose, an anti-rotation element is arranged between the magnetic core and the bushing. In this way, the relative position of the bushing with respect to the magnetic core is always maintained or it is at least always restored when the engaging relay is in the non-excited state, since the bushing then moves deeply into the guide section of the opening. The contact bridge has a fixed rotary-angle assignment with respect to the bushing itself so that a correct alignment of contact bridge with respect to the magnetic core and also to the main current contacts is always ensured.

In accordance with a further development of the invention, there is provision for the anti-rotation element to be formed by a non-circular cross-section of the outer surface of the bushing, and for the guide section of the through-opening to be constructed so as to match the shape of the cross-sectional contour of the outer surface. In particular, the non-circular cross-section can be constructed as a quadrilateral [sic], preferably as a hexagon. In this way, the predetermined rotary-angle position is always maintained between magnetic core and bushing irrespective of the operating state of the engaging relay.

In order to compensate manufacturing tolerances and bearing play, there is preferably provision for the guide section to be of conical construction such that it tapers with increasing depth. This results in the outer surface of the bushing being supported free of play on the guide section in the non-excited state of the engaging relay so that an extremely precise rotary-angle alignment takes place. However, it is also expedient as an additional or alternative feature for the outer surface of the bushing to be of corresponding conical construction such that its cross-section increases in the direction of the contact bridge. This has the advantage of an increased guide and support surface.

In accordance with a further development of the invention, there is provision for the anti-rotation element to be formed by a non-plane end face of the bushing, the end face interacting with a correspondingly shaped head face of the guide section. In the non-excited state of the engaging relay, the end face of the bushing moves onto the head face of the guide section so that an accurately angled alignment of the two parts takes place. The head face is preferably constructed as an annular shoulder of the through-opening, the guide section having, for the purpose of receiving the bushing, a larger diameter than the rest of the through-opening.

In order to form the non-plane end face, teeth which engage in corresponding depressions on the head face can be constructed on the said end face.

Preferably, the teeth are arranged in a circular shape on the end face.

In accordance with a further development, there is provision for the teeth to have obliquely extending edges such that they widen in the direction of the bases of the teeth and taper in the direction of the tops of the teeth, respectively. The depressions on the head face are of corresponding construction so that when the teeth engage in the corresponding depressions a play-free and exact alignment between bushing and magnetic core takes place.

By virtue of the construction of the teeth, the bushing is given a crown-shaped appearance.

Preferably, there is provision for the bushing, and thus the contact bridges, to be capable of being mounted in different rotary-angle positions by rotating by at least one tooth division with respect to the magnetic core. By virtue of this measure, a corresponding angular assignment between contact bridge and magnetic core can thus be carried out during mounting of the engaging relay in order, for example, to be able to allow for particular construction features of an engine compartment of a motor vehicle.

As already mentioned, the contact bridge is attached on the bushing in a rotationally locked manner. This rotationally locked bearing is preferably achieved by means of a nose/recess connection between the aforesaid parts.

In accordance with a preferred exemplary embodiment, the bushing has a collar which has a smaller diameter and engages through a hole on the contact bridge. The nose/recess connection can be constructed on the collar or on the hole, the collar preferably having a nose which extends radially and the hole being provided with a corresponding recess into which the nose engages. However, it is also possible as an additional or alternative feature for the collar to adjoin an annular face of the bushing which is formed by the smaller diameter of the collar with respect to the rest of the outer surface of the bushing, at least one nose being formed on the annular face, which nose engages in a corresponding recess on the contact bridge. Preferably, two diametrically opposite noses and corresponding recesses are provided.

It is advantageous if the nose tapers in the direction of its free end area. The recess is of corresponding construction so that a play-free assignment of the two parts is possible.

In accordance with a further embodiment, there is provision for the angular position between contact bridge and magnetic core to be predetermined depending on the rotary-angle position of the nose/recess connection. This means that for various embodiments of the engaging relay the position of the nose/recess connection can be varied correspondingly so that correspondingly different rotary-angle positions between contact bridge and magnetic core can be achieved in order to allow for particular constructional features. However, there may also be provision for a plurality of recesses to be provided for the selection of different rotary-angle positions of the contact bridge so that during mounting the nose is assigned to a selected recess and, to this extent, an individual rotary-angle position is predetermined.

DRAWING

The invention is explained in greater detail below with reference to the figures, in which:

FIG. 1 shows a longitudinal section through an engaging relay of a starter device of an internal combustion engine, FIG. 2 shows a top view of a bushing for a contact bridge of the engaging relay according to FIG. 1, FIG. 3 shows the bushing in FIG. 2 in a side view, FIG. 4 shows a longitudinal section through an engaging relay in accordance with a different exemplary embodiment, in which case however only the area of a contact chamber is represented, FIG. 5 shows a top view of a bushing for securing a contact bridge in accordance with the exemplary embodiment in FIG. 4, FIGS. 6 to 9 show the bushing of a further exemplary embodiment in longitudinal section, in top view, in side view and in rear view and FIGS. 10 and 11 show a further exemplary embodiment of a polygonal bushing with conical walls.

DESCRIPTION OF EXEMPLARY EMBODIMENTS

Figure 1:
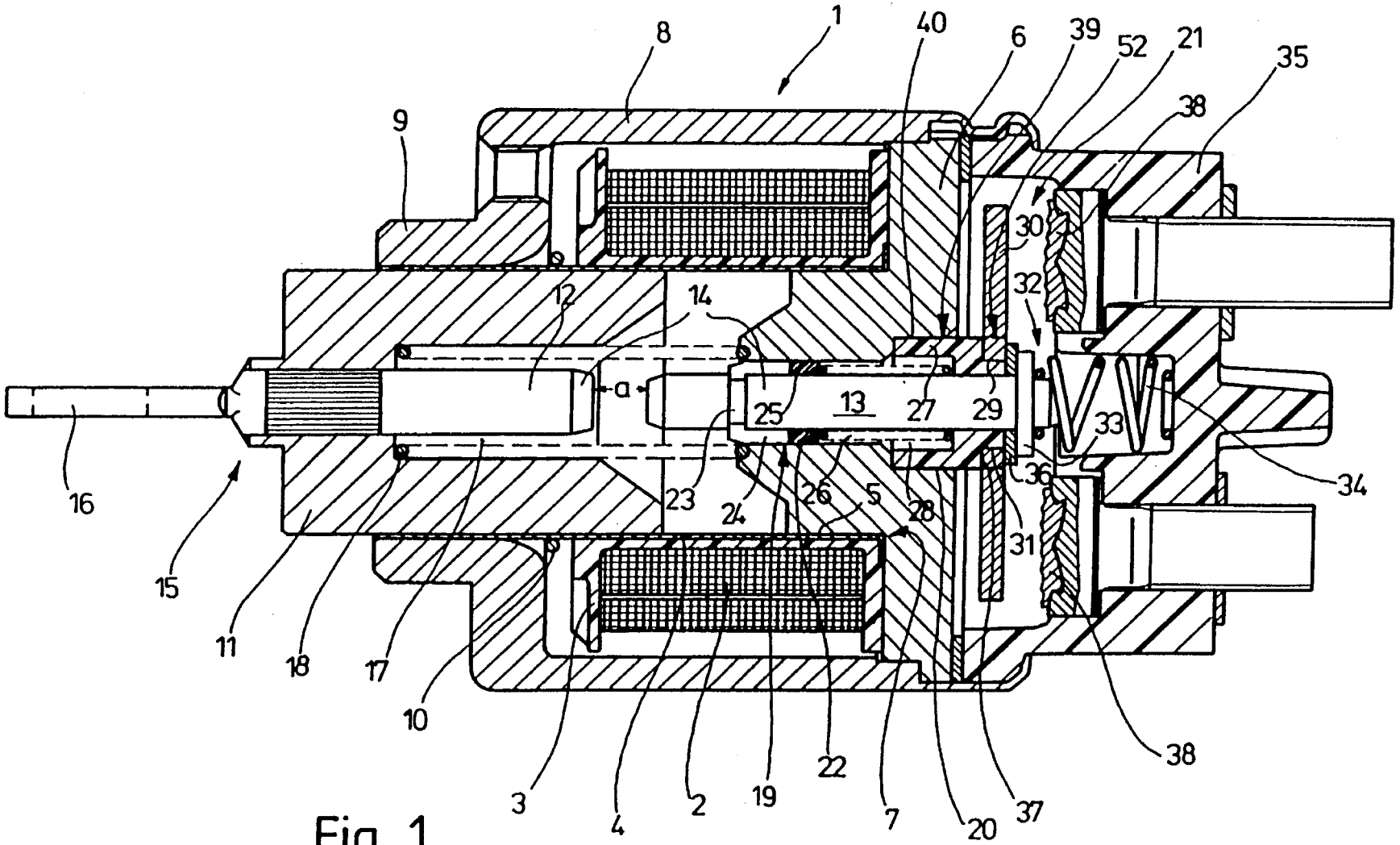

FIG. 1 shows a cross-section through an engaging relay 1 which serves to move a pinion forward for engaging in the ring gear of an internal combustion engine (not illustrated) and is simultaneously used to switch a high starter current for the operation of the starter device using a relatively low control current (which is switched on by means of ignition starter switch).

The engaging relay 1 has a relay coil 2 which is located on a coil holder 3. The coil holder 3 is pushed onto an armature guide tube 4 which engages with its one end over an axial wall 5 of an annular step 7 of a magnetic core 6.

The relay coil 2 is covered by a housing 8 which rests with an end section 9, which has a smaller diameter, on the other end of the armature guide tube 4. One spring 10 is supported on the one hand on an inner wall of the end section 9 and on the other hand on the associated end face of the coil holder 3, as a result of which the coil is forced in the direction of the magnetic core 6 and thus mounted in a vibration-resistant manner.

An armature 11 which has a (divided) switching axle (14) consisting of the parts 12 and 13 is mounted in an axially displaceable fashion in the armature guide tube 4, the part 12 being assigned to the armature 11 and the part 13 to the magnetic core 6. The two parts 12 and 13 are at an axial distance a from one another in the non-excited position of the engaging relay 1 (illustrated in FIG. 1).

At its free end 15, the armature 11 has an actuation extension 16 which, with the intermediate connection of a lever mechanism (not illustrated), serves to move the already mentioned pinion forward.

In addition, the armature 11 is provided with an axial recess 17 which faces the magnetic core 6 and into which a helical compression spring 18 engages with one end and is supported there at the base of the recess 17, the other end of the helical compression spring 18 resting on the magnetic core 6. The helical compression spring 18 thus forms a restoring spring for the armature 11.

The part 13 of the switching axle 14 is mounted in a through-opening 19 of the magnetic core 6. The through-opening 19 has a guide section 20 which has a larger diameter, faces a contact chamber 21 and has an area 22 which has a smaller diameter and faces the armature 11. The part 13 of the switching axle 14 has an annular groove 23 into which a bearing sleeve 24 engages. The bearing sleeve 24 is guided in an axially displaceable fashion with its outer surface in the area 22 of the through-opening 19. In this arrangement, a contact spring 26 is supported with one end on the upper section 25 of the bearing sleeve 24 and with its other end on a bushing 27, the bushing 27 being mounted in an axially displaceable fashion in the guide section 20 of the through-opening 19. The contact spring 26 engages in a blind hole 28 of the bushing 27, the said spring 26 being supported on the base of the blind hole 28.

The bushing 27 is provided with a collar 29 which has a smaller diameter and onto which a contact bridge 30 is fitted. The collar 29 engages through a hole 31 of the contact bridge, means being provided which bring about a rotationally locked securing between bushing 27 and contact brige 30.

In the area of its free end 32, located within the contact chamber 21, the part 13 of the switching axle 14 has a stop collar 33 on which a compression spring 34 is supported with its one free end, its other free end resting on the inside of a cover 35 of a housing. In the interior of the cover 35 of the housing, the already mentioned contact chamber 21 is constructed.

On the other side of the stop collar 33, a plate 36 made of insulating material rests, the said plate 36 having a larger diameter than the collar 29. Between an annular face 37, adjoining the collar 29, of the bushing 27 and of the plate 36 made of insulating material, the contact bridge 30 is arranged, said contact bridge 30 being clamped in between the aforesaid parts by means of the contact spring 26. In this way, the contact bridge 30 is held on the one hand in a defined, but resilient position on the part 13 of the switching axle 14 and can provide the appropriate contact pressure for switching the main current. The contact bridge 30 interacts to this end with main current contacts 38 which are arranged on the cover 35 of the housing.

According to the invention, an anti-rotation element 39 is provided between the bushing 27 and the magnetic core 6. This causes the bushing 27 always to maintain its angular position with respect to the magnetic core 6 during the operation of the engaging relay 1 so that the contact bridge 30 which is held rotationally locked on the bushing 27 always maintains the desired position with respect to the main current contacts 38.

Figure 2:
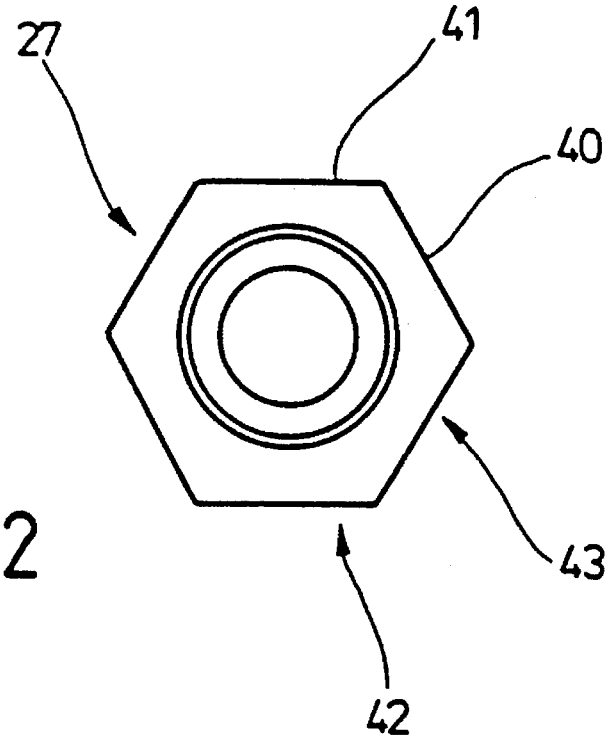
Figure 3:
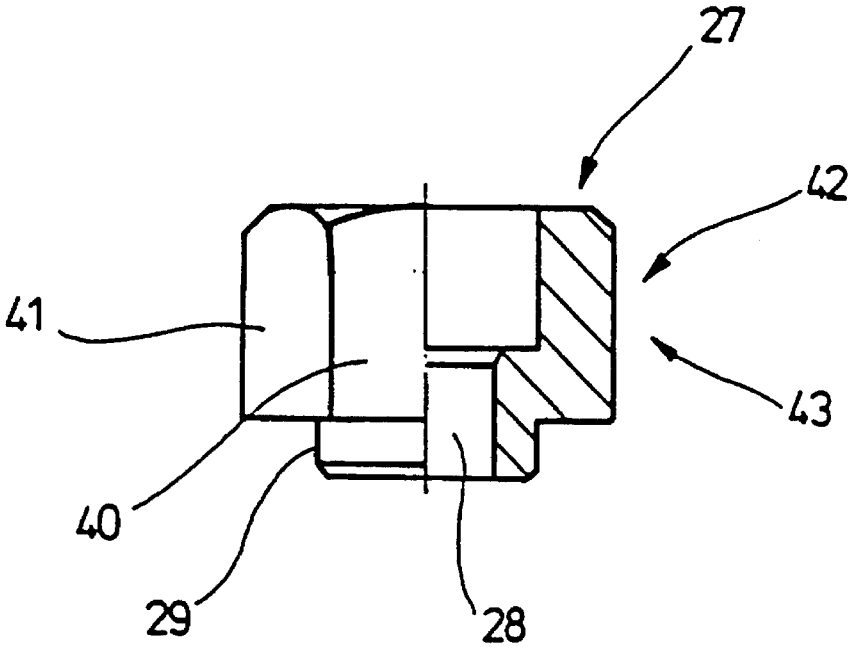

In accordance with the exemplary embodiment in FIGS. 1 to 3, the bushing 27 has, for the purpose of forming the anti-rotation element 39, a non-circular cross-section 40 with respect to its outer surface 41, the guide section 20 of the through-opening 19 being constructed so as to fit the shape of the non-circular cross-section configuration so that the two parts cannot rotate with respect to one another.

Preferably, the non-round cross-section is constructed as a polygon 42, in particular as a hexagon 43.

During the operation of the engaging relay, the following function is effected: if the relay coil 2 of the engaging relay 1 is excited, the armature 11 is drawn into the interior of the relay coil 2, as a result of which the axial distance a between the two parts 12 and 13 of the two-component switching axle 14 is continuously reduced until the two parts 12 and 13 abut one another axially, as a result of which the armature 11 displaces the part 13 of the switching axle 14 to the right (FIG. 1). The part 13 of the switching axle 14 moves the contact bridge 30 with it via the bushing 27, which contact bridge 30 finally makes contact with the main current contacts 38 in order to switch on the main current. The switching path is dimensioned in such a way that the bushing 27 always remains with a part of its cross-section 40 inside the guide section 20, a fixed angular position being maintained between these parts by virtue of the non-circular cross-section 40 and the correspondingly designed cross-section configuration of the guide section 20.

FIGS. 4 to 9 show further exemplary embodiments of an engaging relay which corresponds in design to the exemplary embodiment in FIG. 1, but which merely has a differently constructed anti-rotation element 39 on the bushing 27, further details will be given below relating to the said anti-rotation element 39.

The anti-rotation element 39 of the second and third exemplary embodiment is formed by a non-plane end face 44 of the bushing 27 and a correspondingly shaped head face 45 of the guide section 20 of the through-opening 19. The head face 45 is produced by virtue of the guide section 20 which has a larger diameter than the rest 22 of the through-opening 19. To this extent, the head face 45 forms an annular step 46 of the through-opening 19.

In particular, the anti-rotation element 39 is formed, as can be seen from FIGS. 4 to 9, in that axially directed teeth 47 are arranged on the end face 44, which teeth 47 engage in corresponding depressions 48 on the head face 45 when the engaging relay 1 is in the non-excited state. The teeth 47 are preferably arranged in a circular shape on the end face 44, as a result of which the bushing 27 is given a crown-shaped appearance.

The teeth have edges 49 which extend obliquely in such a way that they widen in the direction of the bases 50 of the teeth and taper in the direction of the tops 51 of the teeth, respectively. A corresponding construction is provided in the case of the depressions 48.

In order to obtain the rotationally locked bearing, already mentioned, of the contact bridge 30 on the bushing 27, a nose/recess connection 52 between these parts is provided. This nose/recess connection 52 can be provided on the collar 29 in the form of one or more noses and on the hole 31 of the contact bridge 30 in the form of one or more corresponding recesses. In the illustrated exemplary embodiment of the figures, there is provision for noses 53 to be provided on the annular face 37 of the bushing 27, which noses 53 engage in corresponding recesses 54 on the contact bridge. Preferably, two noses 53 which lie diametrically opposite one another are provided. These noses 53 taper in the direction of their free end areas; the recesses 54 are of corresponding construction so that the bushing 27 holds the contact bridge 30 in a rotationally locked manner.

If a plurality of recesses 54 are provided on the contact bridge 31 [sic], different rotary-angle positions can be produced between contact bridge 30 and bushing 27 depending on which of the recesses 54 the noses 53 engage in. This permits a correspondingly different arrangement of the main current contacts 38 on the housing cover 35 to be provided in order, if appropriate, to be able to allow for special constructional features of an internal combustion engine or the like.

Correspondingly, it is also possible to provide a desired tooth engagement for the presetting of a rotary-angle position between guide section 20 and bushing 27 during the mounting of the engaging relay; this is also possible in the case of the exemplary embodiment in FIG. 1 in that the hexagon 43 is aligned in correspondingly predetermined rotary-angle position with respect to the guide section 20, the rotary-angle position, once specified during mounting, then being maintained during the further operation of the engaging relay.

Figure 4:
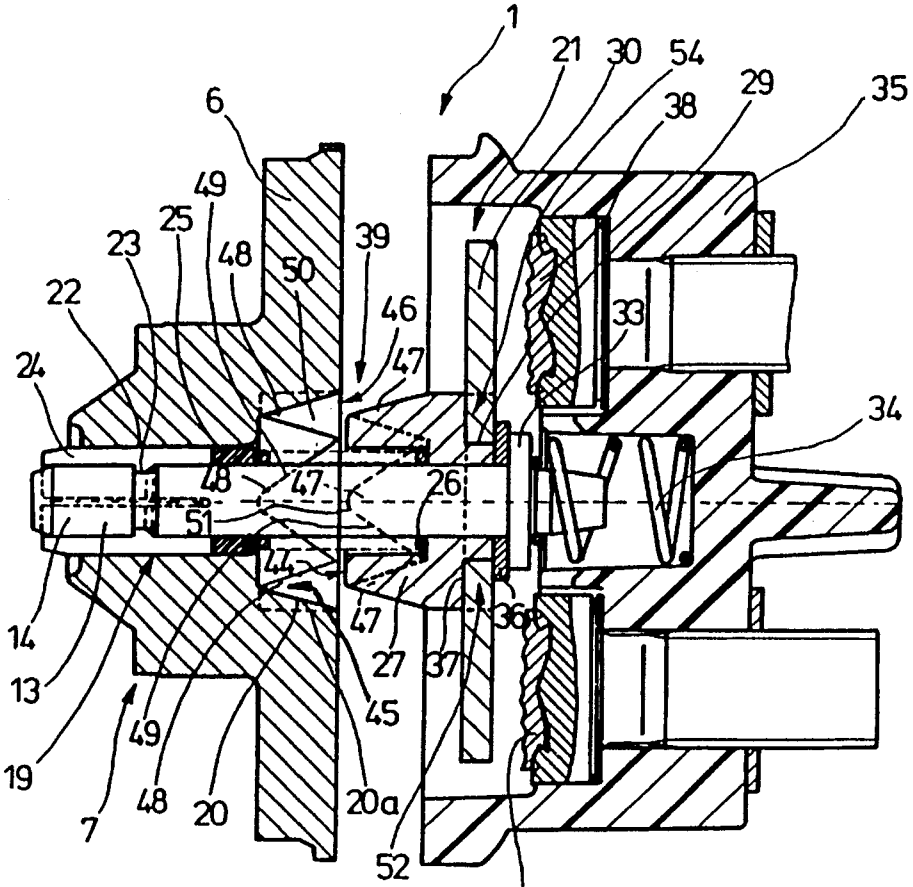
Figure 5:
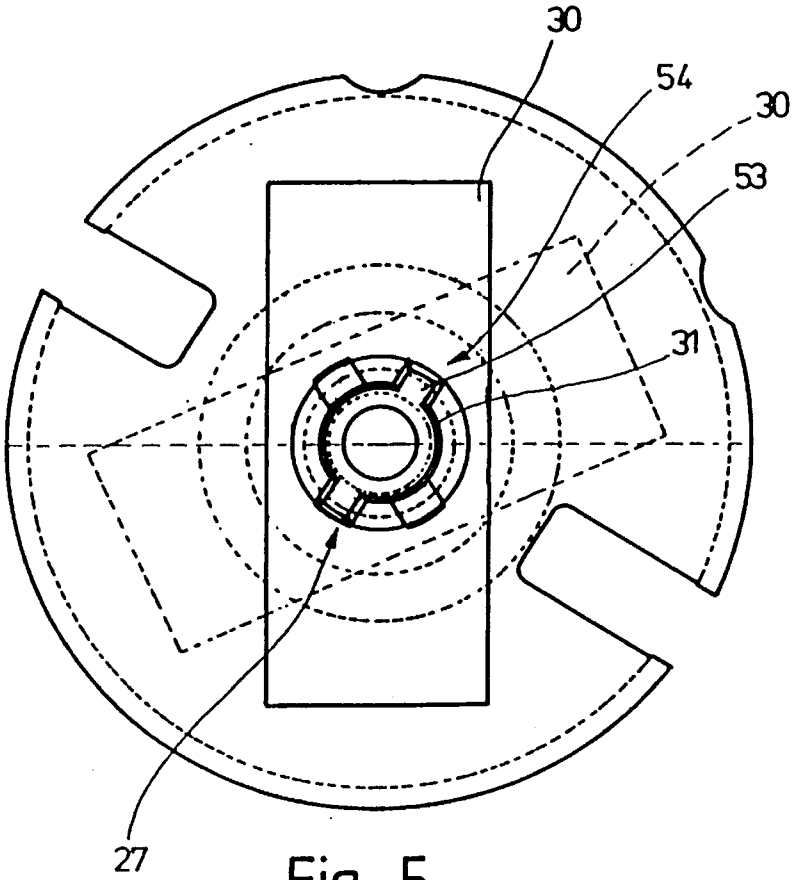
Figure 6:
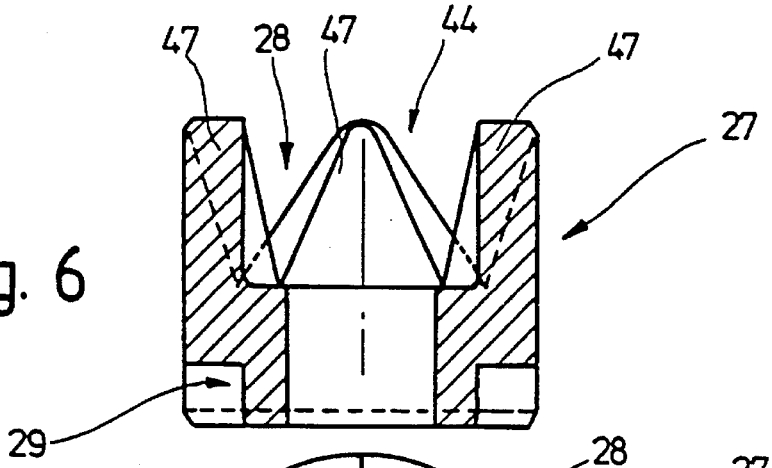
Figure 7:
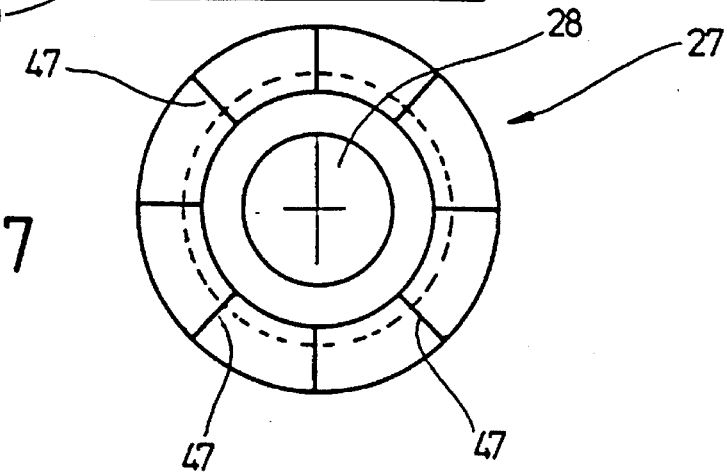
Figure 8:
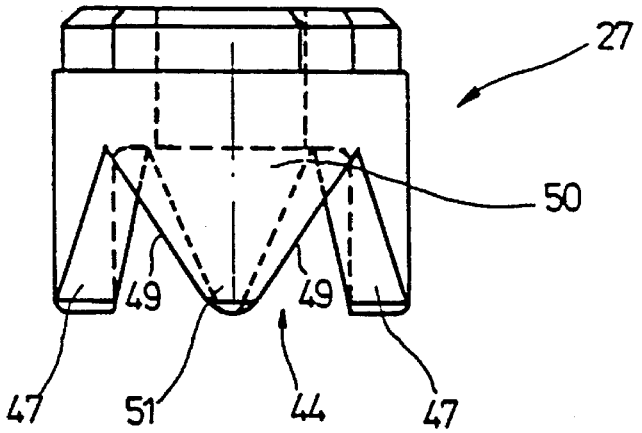
Figure 9:
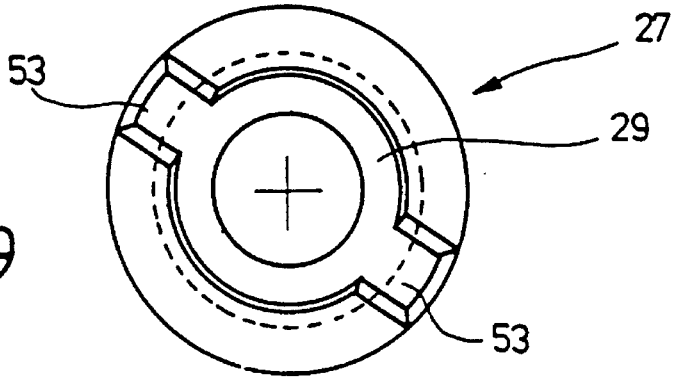

In accordance with the second exemplary embodiment according to FIGS. 4 and 5, the outer surface of the bushing 27 is of conical construction in the area of the teeth 47, its cross-section increasing in the direction of the contact bridge 30. Correspondingly, the guide section 20 at the through-opening 19 of the magnetic core 6 is also of conical construction in that it tapers with increasing depth.

In contrast, in the third exemplary embodiment according to FIGS. 6 to 9 the bushing 27 is of cylindrical construction. It engages in a guide section, which is correspondingly of cylindrical construction, of the magnetic core 6, as is indicated in FIG. 4 with 20*a* using broken lines.

Figure 10:
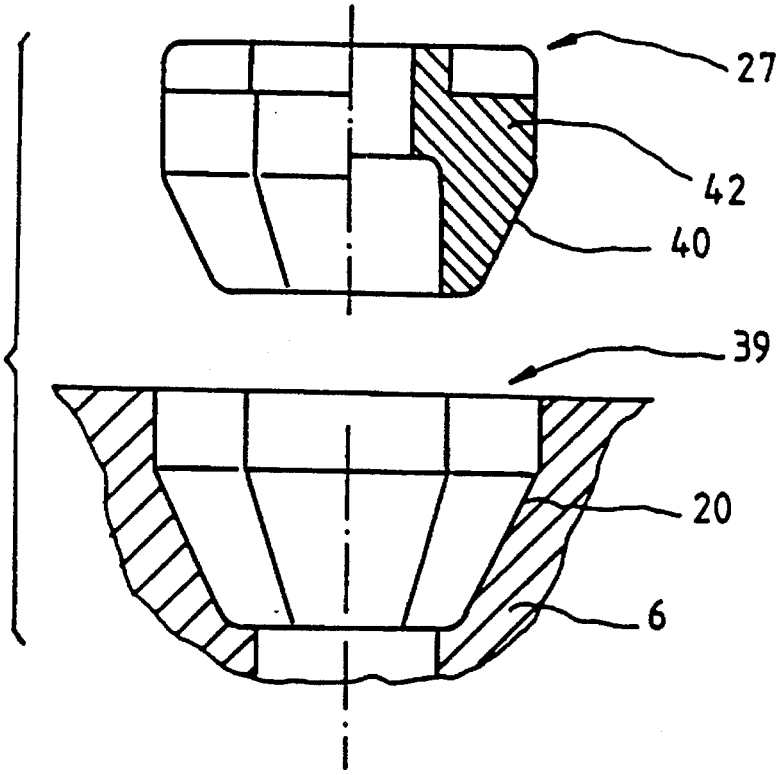
Figure 11:
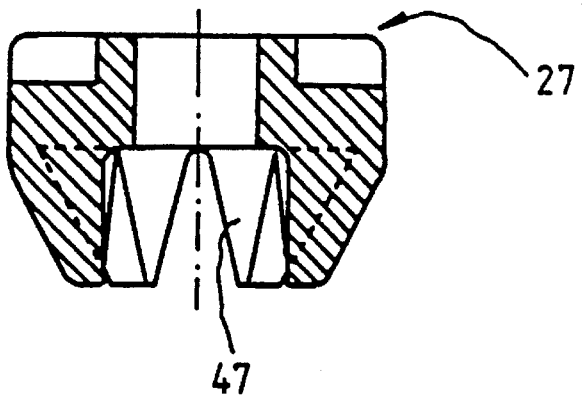

FIGS. 10 and 11 show two variants of the exemplary embodiment in FIGS. 1 to 3 since here a conically extending cross-section 40 is provided in the case of the anti-rotation element 39, that is to say the faces of the polygon 42 extent obliquely, a corresponding configuration being provided in the guide section 20. This results in the bushing 27 being mounted free of play in the guide section 20 when the engaging relay is not excited.

A further advantageous variant of an anti-rotation element consists in also providing the hexagon guide, of conical construction, of the guide bushing 27 according to FIG. 11 with a toothed contour 47 at the end facing away from the contact plate and designing the guide section at the through-opening of the magnetic core 6 correspondingly.

We claim:

1. Engaging relay for a starter device of an internal combustion engine, said engaging relay comprising a magnetic core having an assigned relay coil and provided with a through-opening having a guide section;

an armature including a switching axle penetrating the through-opening of the magnetic core;

a bushing mounted in an axially displaceable manner around the switching axle and in said guide section of said through-opening;

a contact bridge carried by said bushing and fixed to said bushing to prevent rotation of said bushing relative to said contact bridge;

main current contacts positioned opposite to the contact bridge;

spring means for holding said contact bridge away from said main current contacts in a resting position of said contact bridge; and anti-rotation means for preventing rotation of said bushing in said guide section relative to said magnetic core to constantly maintain said contact bridge in a rotationally fixed relationship with said main current contacts in said housing cover.

2. Engaging relay as defined in claim 1, wherein said bushing has a noncircular cross-section and said guide section has a noncircular cross-section shaped to match said noncircular cross-section of said bushing so that said bushing cannot rotate in said guide section.

3. Engaging relay as defined in claim 2, wherein said noncircular cross-section of said bushing is polygonal.

4. Engaging relay as defined in claim 2, wherein said noncircular cross-section of said bushing is hexagonal.

5. Engaging relay as defined in claim 1, wherein said guide section of said through-opening is conical and tapers inwardly.

6. Engaging relay as defined in claim 1, wherein said bushing is conical and has a cross-section increasing toward said contact bridge.

7. Engaging relay as defined in claim 1, wherein said contact bridge is attached to one end of said bushing, another end of said bushing remote from said contact bridge has a nonplanar end face and said guide section has a head face shaped to fit said nonplanar end face of said bushing so as to prevent rotation of said bushing in said guide section.

8. Engaging relay as defined in claim 7, wherein said head face of said guide section is formed by an annular shoulder of said through-opening and said guide section has a diameter larger than a diameter of a portion of said through-opening not including said guide section.

9. Engaging relay as defined in claim 7, wherein said end face is provided with teeth and said head face is provided with depressions in which said teeth are engagable.

10. Engaging relay as defined in claim 9, wherein said teeth are arranged in a circular pattern on said end face.

11. Engaging relay as defined in claim 9, wherein each of said teeth have a base and a top as well as oblique extending edges and taper in a direction from said base to said top.

12. Engaging relay as defined in claim 9, wherein each of said teeth has a base and a top as well as oblique extending edges and tapers in a direction from said base to said top.

13. Engaging relay as defined in claim 9, wherein said teeth are arranged on said bushing so that said bushing and said contact bridge connected to said bushing can be mounted at different rotary positions by rotating by at least one tooth division relative to said magnetic core.

14. Engaging relay as defined in claim 1, wherein said contact bridge is attached to said bushing in a rotationally locked manner by a nose/recess connection.

15. Engaging relay as defined in claim 13, wherein said bushing is provided with a collar having a diameter smaller than that of a portion of said bushing not including said collar, and said contact bridge is provided with a hole in which said collar engages, said nose/recess connection being formed in the vicinity of said collar and hole.

16. Engaging relay as defined in claim 14, wherein said bushing has an annular face adjoining said collar and said annular face has at least one nose and said contact bridge has at least one recess for each of said noses so as to form said nose/recess connection, each of said recesses fitting each of said noses.

17. Engaging relay as defined in claim 15, further comprising means for determining an angular position between said contact bridge and said magnetic core according to a rotary angle position of said nose/recess connection.

18. Engaging relay as defined in claim 16, wherein said means for determining said angular position includes a plurality of said recesses in said contact bridge.

* * * * *